US010329820B2

(12) United States Patent
Hickman

(10) Patent No.: US 10,329,820 B2
(45) Date of Patent: Jun. 25, 2019

(54) SPRING ADJUSTMENT INDICATOR FOR A DOOR CLOSURE

(71) Applicant: BEST ACCESS SOLUTIONS, INC., Indianapolis, IN (US)

(72) Inventor: Chad A. Hickman, Indianapolis, IN (US)

(73) Assignee: DORMAKABA USA INC., Indianapolis, IN (US)

( * ) Notice: Subject to any disclaimer, the term of this patent is extended or adjusted under 35 U.S.C. 154(b) by 141 days.

(21) Appl. No.: 15/033,665

(22) PCT Filed: Oct. 30, 2014

(86) PCT No.: PCT/US2014/063042

§ 371 (c)(1),
(2) Date: May 2, 2016

(87) PCT Pub. No.: WO2015/066265

PCT Pub. Date: May 7, 2015

(65) Prior Publication Data

US 2016/0273257 A1 Sep. 22, 2016

Related U.S. Application Data

(60) Provisional application No. 61/898,545, filed on Nov. 1, 2013.

(51) Int. Cl.
*E05F 1/00* (2006.01)
*E05F 3/00* (2006.01)
(Continued)

(52) U.S. Cl.
CPC ..... *E05F 3/22* (2013.01); *E05F 3/00* (2013.01); *E05F 3/10* (2013.01); *E05F 1/00* (2013.01);
(Continued)

(58) Field of Classification Search
CPC ..... E05F 1/00; E05F 3/00; E05F 3/10; E05F 3/22; E05Y 2201/492; E05Y 2400/82; E05Y 2900/132
(Continued)

(56) References Cited

U.S. PATENT DOCUMENTS 1,632,924 A 6/1927 Schmidt
2,453,924 A 11/1948 McFadden
(Continued)

FOREIGN PATENT DOCUMENTS

EP 0097868 A2 1/1984
EP 292743 A1 * 11/1988 ..... E05F 3/22
(Continued)

OTHER PUBLICATIONS

PCT US 2014 063042, Written Opinion of the ISA, dated Jan. 29, 2015.*
(Continued)

*Primary Examiner* — Lisa M Caputo
*Assistant Examiner* — Tania C Courson
(74) *Attorney, Agent, or Firm* — Faegre Baker Daniels LLP

(57) ABSTRACT

A spring force indicator for a door closure having a spring force adjuster comprises a drive wheel coupled to the spring force adjuster for rotation therewith and a driven wheel. The driven wheel includes a disc and a post extending from the disc, the post being disposed in a bore formed in a front surface of the door closure and adapted to engage the drive wheel for rotation therewith. A cover being disposed on the end of the door closure and configured to cover the drive wheel and the driven wheel. The cover includes a sidewall, a central aperture for receiving the spring force adjuster, a second aperture disposed between the central aperture and the sidewall, and second indicia disposed around the second
(Continued)

aperture. The disc includes first indicia visible through the second aperture which cooperates with the second indicia to indicate a measure of spring force.

15 Claims, 6 Drawing Sheets

(51) Int. Cl.
*E05F 3/10* (2006.01)
*E05F 3/22* (2006.01)

(52) U.S. Cl.
CPC ..... *E05Y 2201/492* (2013.01); *E05Y 2400/82* (2013.01)

(58) Field of Classification Search
USPC ..... 16/78–80, DIG. 9, DIG. 10
See application file for complete search history.

(56) References Cited

U.S. PATENT DOCUMENTS 2,540,525 A 2/1951 Howarth et al.
2,660,719 A 11/1953 Stromberg
2,767,681 A * 10/1956 Pontius ..... F16K 37/0016 116/277
2,885,721 A * 5/1959 Lipschutz ..... E05F 3/06 16/59
2,996,754 A 8/1961 Ziegler et al.
3,161,908 A 12/1964 Walach
3,335,451 A 8/1967 Patriquin
3,392,419 A 7/1968 Stein et al.
3,531,820 A 10/1970 Koivusalo
3,555,591 A 1/1971 Sogoian
3,593,367 A 7/1971 Waldo
3,708,826 A 1/1973 Larson
3,781,943 A 1/1974 Cain
3,934,307 A 1/1976 Lasier et al.
4,016,827 A 4/1977 Lawrence, Jr.
4,103,881 A 8/1978 Simich
4,545,322 A 10/1985 Yang
4,590,639 A * 5/1986 Fritsche et al. ..... E05F 3/10 116/204
4,686,739 A * 8/1987 Fritsche et al. ..... E05F 3/10 16/62
4,783,882 A * 11/1988 Frolov ..... E05F 3/00 16/49
4,785,493 A 11/1988 Tillmann et al.
5,163,204 A 11/1992 Jackson
5,265,306 A 11/1993 Yu
5,497,725 A 3/1996 Theisen et al.
5,657,511 A 8/1997 Lan
5,666,692 A 9/1997 Toledo
5,687,507 A 11/1997 Beran
6,167,589 B1 1/2001 Luedtke
6,282,750 B1 * 9/2001 Bishop et al. ..... E05F 3/10 16/277
6,435,026 B1 8/2002 Donehue
6,681,652 B2 * 1/2004 Auer et al. ..... B62K 23/04 116/28.1
6,871,381 B1 3/2005 Luca
7,025,343 B2 4/2006 Chou
7,070,375 B2 7/2006 Hoeckelman
8,732,905 B2 * 5/2014 Bell ..... E05F 3/102 16/71
9,695,620 B2 * 7/2017 Zasowski et al. ..... E05F 1/105
2003/0097793 A1 * 5/2003 Kowalczyk et al. ... E05D 15/54 49/333
2011/0257797 A1 * 10/2011 Burris et al. ..... E05F 3/102 700/282
2011/0288794 A1 * 11/2011 Chen ..... G01F 1/065 702/45
2014/0109632 A1 4/2014 Horne et al.
2014/0331913 A1 * 11/2014 Emanuel et al. ... F16K 37/0016 116/201

FOREIGN PATENT DOCUMENTS

EP 0292743 A1 11/1998
FR 2574554 A1 6/1986
GB 2158148 A * 11/1985 ..... E05F 3/102
GB 2158148 A 11/1985
GB 2180294 A 3/1987

OTHER PUBLICATIONS

PCT US 2014 063042, International Search Report, dated Jan. 29, 2015.*

* cited by examiner

SPRING ADJUSTMENT INDICATOR FOR A DOOR CLOSURE

The present invention relates generally to door closures and spring adjustment indicators for door closures in particular.

BACKGROUND OF THE INVENTION

Door closers are known in the art. In the conventional closure, a rack extends along the longitudinal axis of the closure and a pinion extends along a transverse axis and engages the rack. An internal closure spring extends between the rack and a disc so as to bias the rack. A spring force adjuster threadedly engages the disc to move the disc toward or away from the rack, thereby increasing or decreasing the compression of the spring, and the force on the rack, thereby increasing or decreasing the rate of closure of a door. The above description can be applied to a closure used with the present invention.

An example of a door closer is disclosed in U.S. Pat. No. 6,282,750, issued Sep. 4, 2001 to Bishop et al., which patent is hereby incorporated by reference herein in its entirety. The '750 patent also discloses an arrangement for providing a rotatable indicator of the ANSI closing force with which the user preloads the spring. The '750 system utilizes a rotatable indicator and a ring gear that is driven by a double- or single-toothed gear connected to a rotatable spring force adjuster. When the user rotates the spring force adjuster, the gear rotates the ring gear about the rotatable spring force adjuster. When the rotatable indicator is rotated, indicia formed on the rotatable indicator are thereby also rotated to a specific orientation relative to the user, which thereby indicates what ANSI force number has been selected.

SUMMARY OF THE INVENTION

A spring force indicator for a door closure having a spring force adjuster comprises a drive wheel coupled to the spring force adjuster for rotation therewith and a driven wheel. The driven wheel includes a disc and a post extending from the disc, the post being disposed in a bore formed in a front surface of the door closure and adapted to engage the drive wheel for rotation therewith. The disc further includes first indicia.

A cover includes a base wall and a cylindrical sidewall depending from the base wall, the cover being disposed on the end of the door closure and configured to cover the drive wheel and the driven wheel. The cover includes a central aperture for receiving the spring force adjuster, a second aperture disposed between the central aperture and the sidewall, and second indicia disposed around the second aperture. The first indicia is visible through the second aperture, and the first indicia cooperates with the second indicia to indicate a measure of spring force.

In one embodiment, the first indicia includes an arrow and the second indicia includes a plurality of numbers indicating an ANSI force. As the spring force adjuster is rotated, the arrow points at successive numbers.

In one embodiment, the drive wheel includes at least one gear tooth and the driven wheel includes a plurality of gear teeth.

Other benefits and advantages will be apparent to one of ordinary skill in the art upon consideration of the following description of the invention.

DETAILED DESCRIPTION OF THE DRAWINGS

Figure 1:
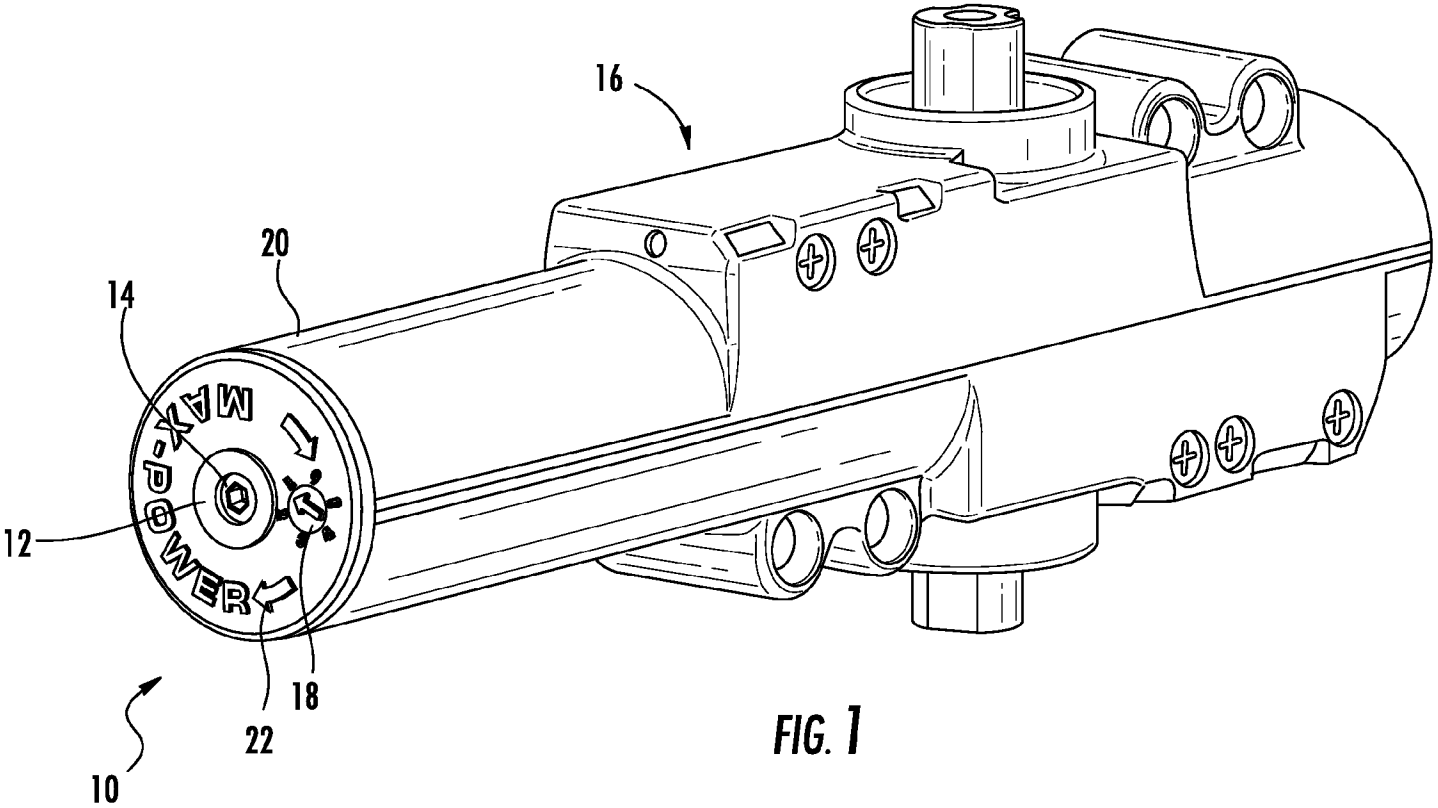
FIG. 1 is a perspective view of a door closure incorporating an exemplary spring adjustment indicator according to the present invention.

The spring adjustment indicator 10 of the present invention is illustrated in FIG. 1 and includes a drive wheel 12 coupled to a spring force adjuster 14 of a door closure 16, a driven wheel 18 mounted on a first end 20 of the closure 16 and engaged by the drive wheel 12, and a cover 22 coupled to a door closure 16. The remainder of the closure 16 can be conventional and will not be discussed further.

Figure 2:
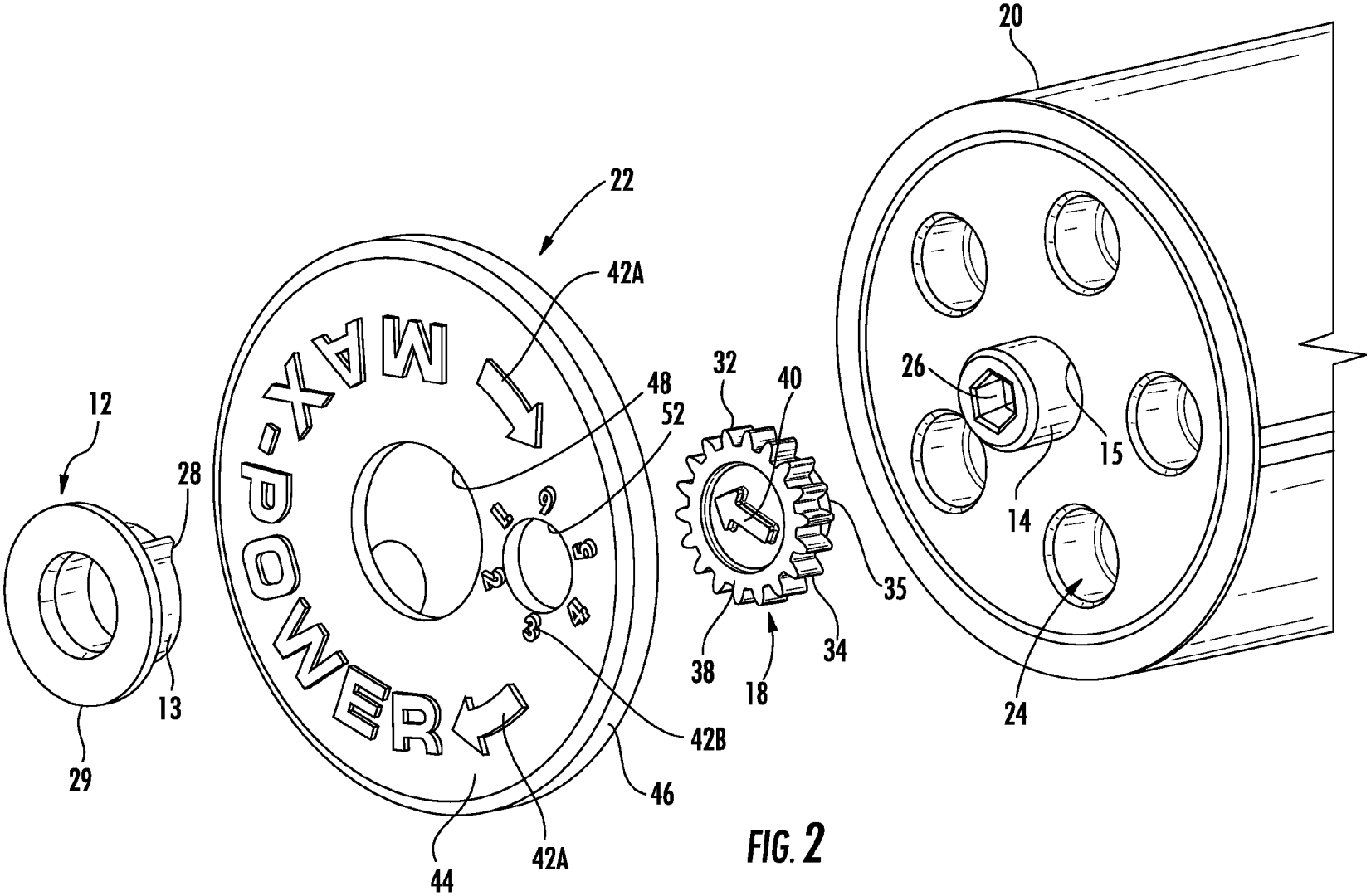
FIG. 2 is a partially exploded view of the door closure of FIG. 1 illustrating a drive wheel, a driven wheel and a cover.

As illustrated in FIGS. 1-2, the first end 20 of the closure 16 includes a central aperture 15 for receiving the spring force adjuster 14 and at least one recess 24 for receiving the driven wheel 18. The spring force adjuster 14 can extend beyond the first end 20 and can include a central bore 26 configured to receive a drive tool, such as an allen wrench or the like.

Figure 3:
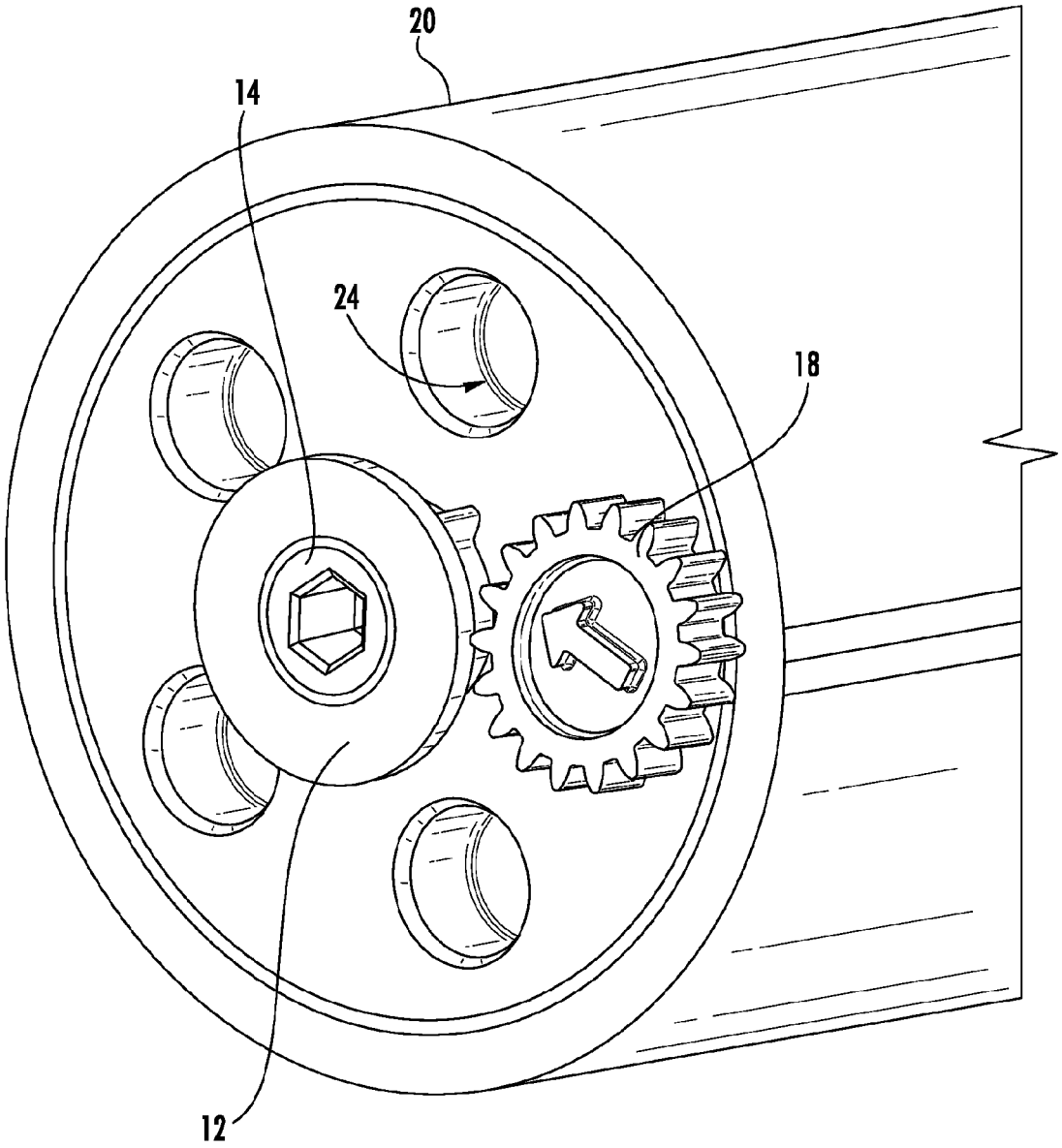
FIG. 3 is a partially exploded view of the door closure of FIG. 1 illustrating a driven wheel mounted on a face of the closure for engagement by a drive wheel.
Figure 4:
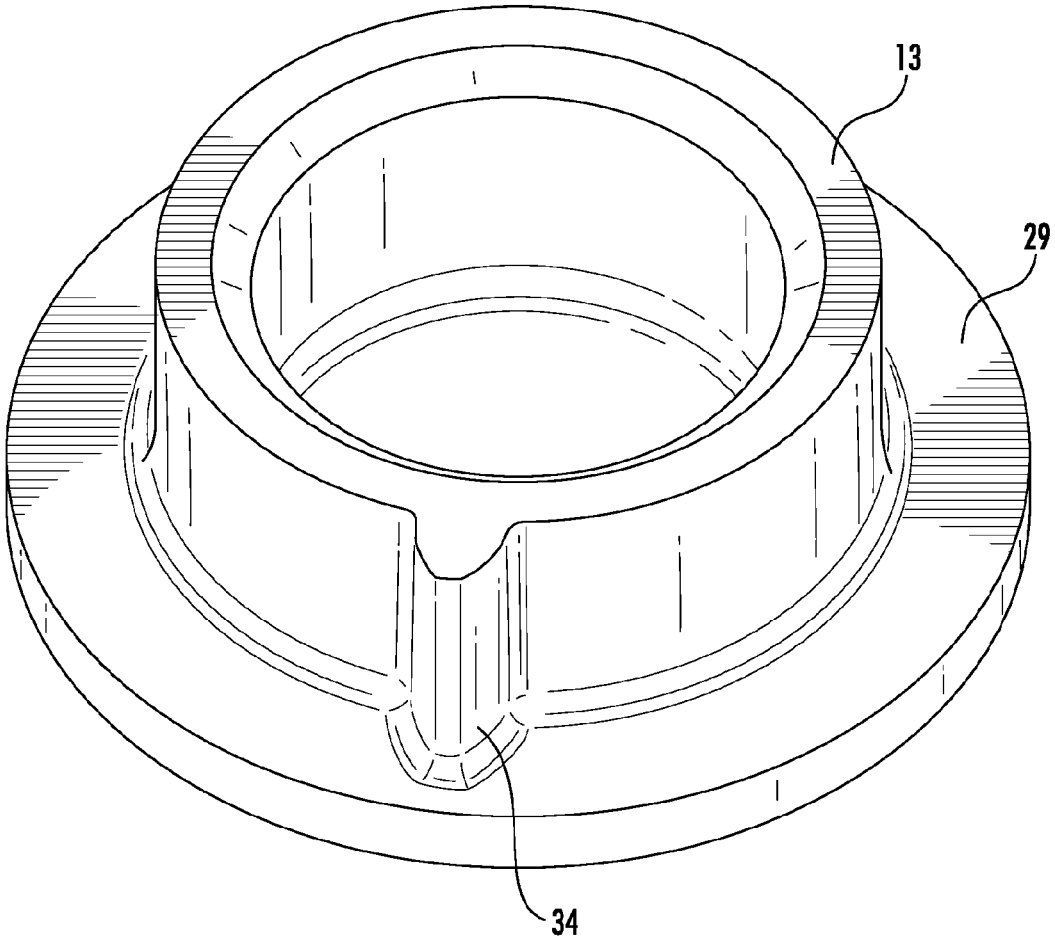
FIG. 4 illustrates an exemplary drive wheel.
Figure 5:
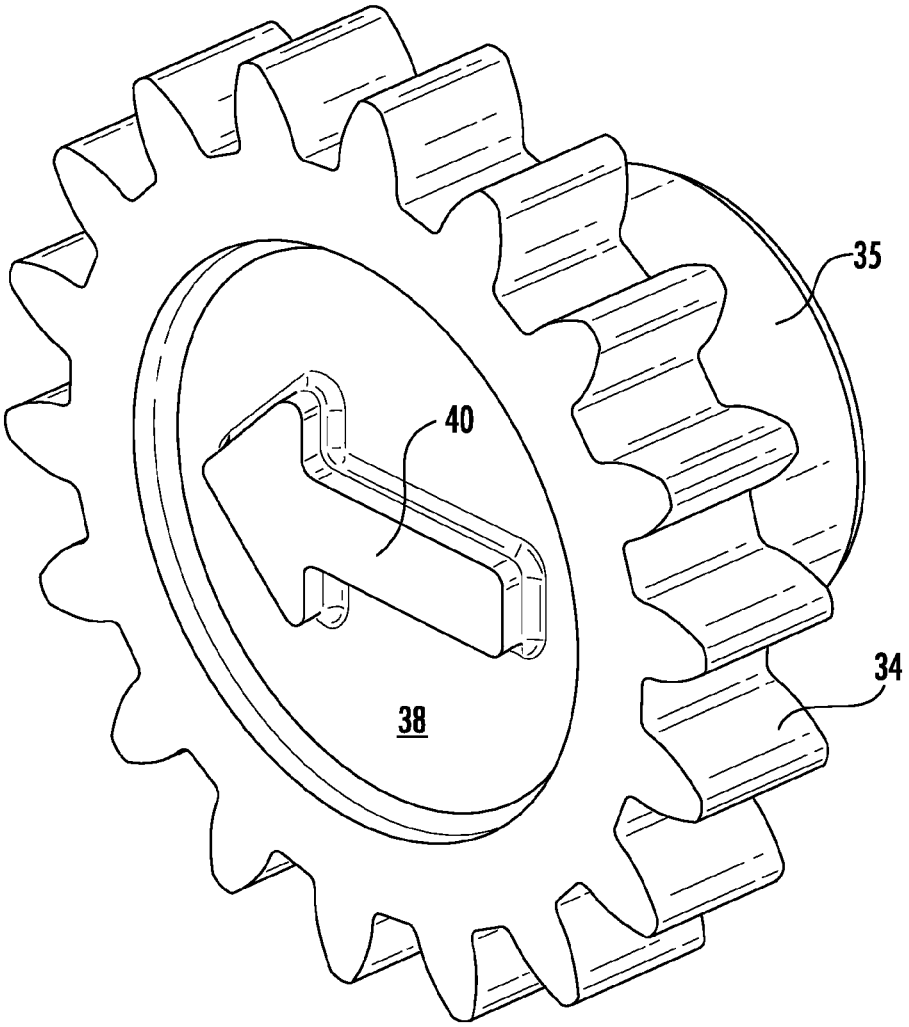
FIG. 5 illustrates an exemplary driven wheel.
Figure 6:
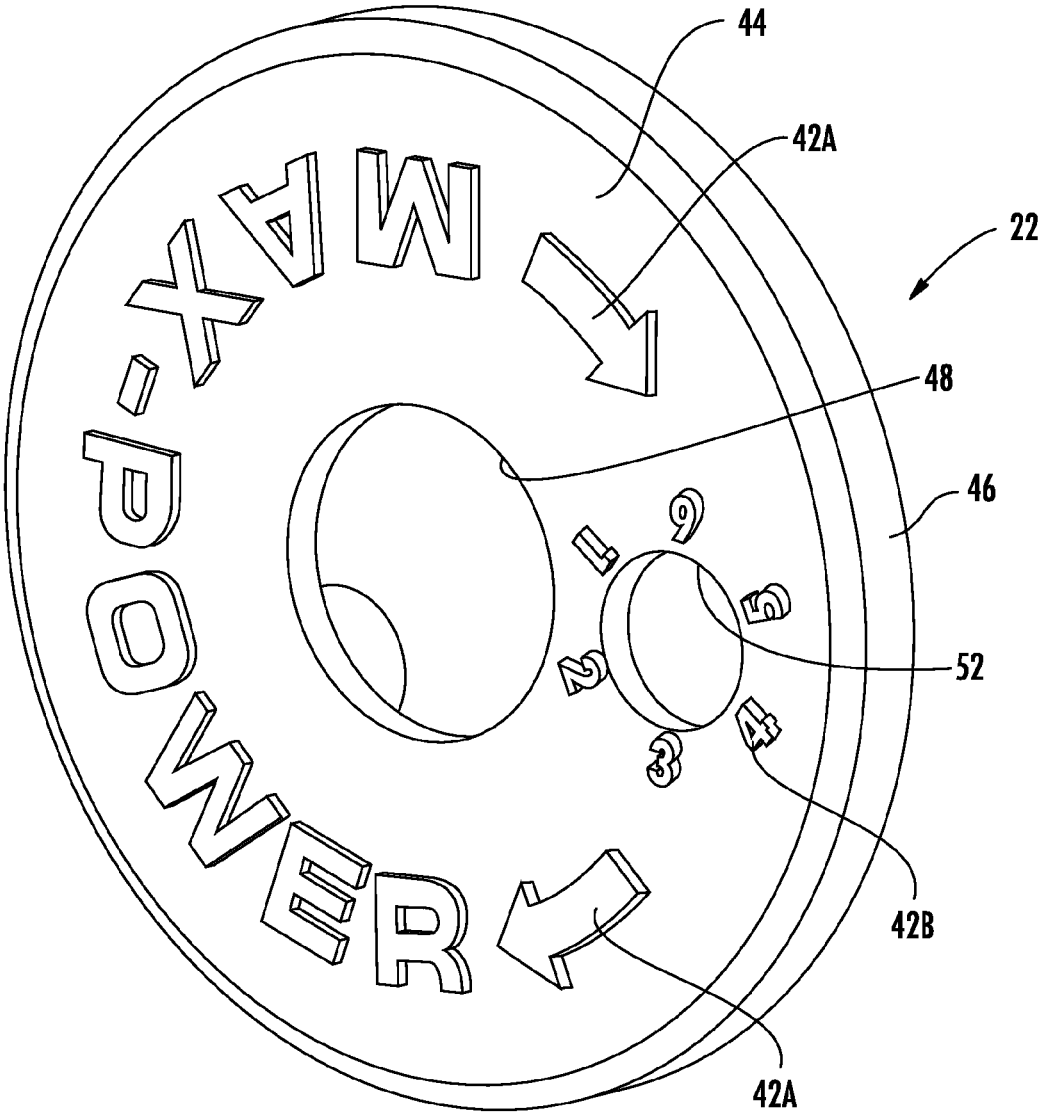
FIG. 6 illustrates an exemplary cover.

The drive wheel 12 can be a ring 13 having a one or more teeth 28, depending on the application, extending radially outwardly from the outer periphery of the ring 13 as best seen in FIG. 4. The inner diameter of the ring 13 can be sized to provide a friction fit around the spring force adjuster 14 as illustrated in FIG. 3. The driven wheel 18 can include a disc 32 having a plurality of gear teeth 34 extending radially outwardly from the periphery of the disc 32 to engage the teeth 28. A flange 29 can extend radially outwardly from the ring 13 to cover the engagement of the ring 13 with the driven wheel 18 and provide a bearing surface against the cover 22.

A post 35 extends orthogonally from a rear face 36 of the disc 32. The post 35 can be configured for a close fit in a recess 24 and the diameter of the disc 32 is sized to provide a meshing engagement between the single tooth 28 of the drive wheel 12 and the gear teeth 34 of the driven wheel 18, as best seen in FIG. 3. The disc 32 can further include a front face 38 displaying indicia 40.

The cover 22 can be generally cup-shaped with a base wall 44 and a circular sidewall 46 depending from the base wall 44. The base wall 44 can include a central aperture 48 for receiving the spring force adjuster 14 and a second aperture 52 located between the central aperture 48 and the sidewall 46. The cover 22 can also include multiple indicia 42A, 42B. Indicia 42A can indicate the direction of rotation of the spring force adjuster 14 to increase and/or decrease the force applied by the spring 4. Indicia 42B can surround the second aperture 52 and indicate the amount of force applied by the spring 4. The sidewall 46 can include a plurality of tabs (not shown) extending radially inwardly and configured to engage an annular groove (not shown) formed in a sidewall 58 of the door closure 16 to retain the cover 22 on the closure 16. The cover 22 can be configured to retain the drive wheel 12 and the driven wheel 18 in position while allowing them to rotate and engage their respective gear(s) or friction surfaces when the cover 22 is properly positioned on the closure 16. When properly installed, the indicia on the driven wheel 18 will be visible through the second aperture 52. In the embodiment illustrated, the indicia 40 is an arrow that will point to indicia 42B on the cover 22.

With the drive wheel 12 and driven wheel 18 installed as indicated in FIG. 3, the cover 22 is installed over the end of the closure 16 so that the tabs engage the groove and the closure 16 appears as shown in FIG. 1. To change the amount of force exerted by the internal closure spring against the rack, a user inserts an allen wrench or the like into the central bore 26 of the spring force adjuster 14 and turns the spring force adjuster 14. The number of gear teeth 34 on the driven wheel 18 will determine the number of revolutions of the spring force adjuster 14 required to rotate the driven wheel 18 enough to change the force indication of the arrow 40 on the driven wheel 18. For example, indicia 42B comprises six digits equally spaced about the second aperture 52, thereby providing one digit every 60° around the second aperture 52. The driven wheel 18 includes 18 gear teeth, or 3 teeth for each 60° sector of the wheel. Thus, the spring force adjuster 14 must rotate 3 full revolutions to rotate the arrow 40 through 60° to change the indication from one digit to the next. Of course, other gearing combinations are possible depending on the requirements of the particular closure.

Alternatively, the drive wheel 12 and driven wheel 18 can engage by friction by varying their respective diameters to provide the appropriate turn ratios. A similar calculation can provide the respective diameters of the drive and driven wheels for a friction engagement.

The invention claimed is:

1. A spring force indicator for a door closure having a spring force adjuster, the spring force indicator comprising:

a drive wheel coupled to the spring force adjuster for rotation therewith;

a driven wheel having a disc and a post extending from the disc, the post being disposed in a bore formed in a front surface of the door closure and adapted to engage the drive wheel for rotation therewith, the disc including first indicia; and a cover having a base wall and a cylindrical sidewall depending from the base wall, the cover being disposed on the end of the door closure and configured to cover the drive wheel and the driven wheel, the cover including a central aperture for receiving the spring force adjuster, a second aperture disposed between the central aperture and the sidewall, and second indicia disposed around the second aperture, the first indicia being visible through the second aperture, the first indicia cooperating with the second indicia to indicate a measure of spring force.

2. The spring force indicator of claim 1 wherein the drive wheel includes at least one gear tooth and the driven wheel includes a plurality of gear teeth.

3. The spring force indicator of claim 1 wherein the first indicia includes an arrow.

4. The spring force indicator of claim 1 wherein the second indicia includes a plurality of numbers indicating an ANSI force.

5. A spring force indicator for a door closure having a spring force adjuster, the spring force indicator comprising:

a drive wheel coupled to the spring force adjuster for rotation therewith;

a driven wheel including a disc and a post extending from the disc, the post being disposed in a recess formed in a surface of the door closure, the disc engaging the drive wheel for rotation therewith; and a cover disposed to cover the surface, the cover including a central aperture for receiving the spring force adjuster and a second aperture providing visual access to the driven wheel, the second aperture bounded by the cover and positioned intermediate the central aperture and an outer edge of the cover, the driven wheel cooperating with the cover to indicate an amount of spring force applied by the spring force adjuster, wherein rotation of the driven wheel indicates a change in a spring force in response to rotation of the spring force adjuster.

6. The spring force indicator of claim 5 wherein the drive wheel includes at least one gear tooth and the driven wheel includes a plurality of gear teeth.

7. The spring force indicator of claim 5 wherein the cover includes a plurality of numbers surrounding the second aperture.

8. The spring force indicator of claim 7 wherein the driven wheel includes an arrow that points to one of the plurality of numbers, the arrow pointing to another of the plurality of numbers in response to rotation of the spring force adjuster.

9. The spring force indicator of claim 5 wherein the cover includes indicia for indicating a direction of rotation of the spring force adjuster to increase or decrease the spring force of a spring in the door closure.

10. The spring force indicator of claim 5, wherein the driven wheel includes a non-numeric visual indicator indicating the change in the spring force in response to rotation of the spring force adjuster.

11. The spring force indicator of claim 10, wherein the non-numeric visual indicator comprises an arrow.

12. A spring force indicator for a door closure having a spring force adjuster, the spring force indicator comprising:

a drive wheel coupled to the spring force adjuster for rotation therewith;

a driven wheel including a disc and a post extending from the disc, the post being disposed in a recess formed in a surface of the door closure, the disc engaging the drive wheel for rotation therewith; and a cover disposed to cover the surface, the cover including a central aperture for receiving the spring force adjuster, a second aperture providing visual access to the driven wheel, and a plurality of numbers surrounding the second aperture, the driven wheel cooperating with the cover to indicate an amount of spring force applied by the spring force adjuster, wherein rotation of the driven wheel indicates a change in a spring force in response to rotation of the spring force adjuster, the drive wheel including an arrow that points to one of the plurality of numbers, the arrow pointing to another of the plurality of numbers in response to rotation of the spring force adjuster.

13. A spring force indicator for a door closure having a spring force adjuster positioned in a housing of the door closure, the spring force indicator comprising:

a tool engagement portion accessible from an exterior of the housing of the door closure, the tool engagement portion being operatively coupled to the spring force adjuster to vary a spring force of the spring force adjuster through a rotation of the tool engagement portion;

a rotatable indicator operatively coupled to the tool engagement portion, the rotatable indicator having a first indicia visible from the exterior of the housing of the door closure independent of an orientation of the rotatable indicator relative to the housing, the orientation of the first indicia being altered in response to the rotation of the tool engagement portion; and a plurality of second indicia visible from the exterior of the housing of the door closure, the plurality of second indicia being spaced about the rotatable indicator, wherein a first orientation of the first indicia relative to the plurality of second indicia indicates a first spring force setting of the spring force adjuster and a second orientation of the first indicia relative to the plurality of second indicia indicates a second spring force setting of the spring force adjuster.

14. The spring force indicator of claim 13, wherein the tool engagement portion is accessible through a first end of the housing and the first indicia of the rotatable indicator is provided on the first end.

15. The spring force indicator of claim 13, wherein both the tool engagement portion and the rotatable indicator are visible when the exterior of the housing is viewed from a first direction.

* * * * *